United States Patent [19]

Takao et al.

[11] Patent Number: 4,508,075

[45] Date of Patent: Apr. 2, 1985

[54] METHOD AND APPARATUS FOR CONTROLLING INTERNAL COMBUSTION ENGINES

[75] Inventors: Mitsunori Takao, Kariya; Toshiaki Mizuno, Nagoya, both of Japan

[73] Assignee: Nippondenso Co., Ltd., Kariya, Japan

[21] Appl. No.: 311,395

[22] Filed: Oct. 14, 1981

[30] Foreign Application Priority Data

Oct. 17, 1980 [JP] Japan ..... 55-145402

[51] Int. Cl.[3] ..... F02P 3/04; F02B 3/00

[52] U.S. Cl. ..... 123/339; 123/440; 123/480; 123/419; 123/436; 123/417; 123/489

[58] Field of Search ..... 123/440, 486, 480, 478, 123/419, 436, 339, 489

[56] References Cited

U.S. PATENT DOCUMENTS

| | | | |
|---|---|---|---|
| 4,197,767 | 4/1980 | Leung | 123/436 |
| 4,223,644 | 9/1980 | Latsch | 123/440 |
| 4,232,643 | 11/1980 | Leshner | 123/436 |
| 4,239,960 | 5/1980 | Woodhouse | 123/436 |
| 4,271,798 | 6/1981 | Seitz et al. | 123/419 |
| 4,322,800 | 3/1982 | Hisegawa et al. | 123/419 |
| 4,327,689 | 5/1982 | Rachel | 123/436 |
| 4,348,728 | 9/1982 | Sagisaka | 123/440 |

*Primary Examiner*—Ronald B. Cox

*Attorney, Agent, or Firm*—Cushman, Darby & Cushman

[57] ABSTRACT

In accordance with an amount of a change or a proportion of the change of at least one of operating parameters, such as a crankshaft rotational speed, an intake pipe pressure, etc., of an internal combustion engine equipped with an electronically controlled fuel injection system, or a rate of incremental change of the amount of the change or the proportion of the change and in dependence on whether air-fuel ratio feedback compensation by the use of an oxygen sensor is effected or not, at least one of control variables, such as a fuel injection quantity, ignition timing, etc., is corrected to ensure stable control of the rotational speed of the engine during its idling and low speed operations.

14 Claims, 7 Drawing Figures

METHOD AND APPARATUS FOR CONTROLLING INTERNAL COMBUSTION ENGINES

BACKGROUND OF THE INVENTION

1. Field of the Invention

The present invention relates to a method and an apparatus for controlling internal combustion engines equipped with an electronically controlled fuel injection system and more particularly to a method and an apparatus for controlling internal combustion engines, which employ electronic control circuitry to control fuel injection quantity, ignition timing, etc., so as to stably control engine rotational speeds at the time of idling and a low speed operation of the engines.

2. Description of the Prior Art

In a known type of internal combustion engine (hereinafter simply referred to as an engine) equipped with a speed-density type electronic fuel injection system, a fuel injection quantity has been determined in such a manner that the basic fuel injection quantities given by a two-dimensional map in accordance with engine speeds and intake pipe pressures, or the basic fuel injection quantities obtained by applying engine speed compensation to the fuel injection quantities determined in accordance with intake pipe pressures determine a value which substantially satisfies a stoichiometric air-fuel ratio, and such basic fuel injection quantities are further compensated for variations in the cooling water temperature, intake air temperature, battery voltage, etc., thereby providing a resultant controlled fuel injection quantity.

However, the above-mentioned basic fuel quantity is determined principally from the value of the intake pipe pressure, and the effect of the engine speed thereon is small as compared with that of the intake pipe pressure.

If any disturbance is applied to an engine operating under no load condition, not only the engine speed and the intake pipe pressure are varied, but also the fuel injection quantity is varied substantially in phase with the variation of the intake pipe pressure for the above-mentioned reason. However, in the case of an engine equipped with a speed-density type electronic fuel injection system, the intake system has a large-capacity surge tank and this gives rise to a phase difference between the engine speed and the intake pipe pressure. Consequently, a phase difference appears between the engine speed and the fuel injection quantity. As a result, if the engine speed decreases, the air-fuel ratio becomes leaner and the torque decreases, which, in turn, further decreases the engine speed. On the contrary, if the engine speed increases, the air-fuel ratio becomes richer and the torque increases, and this results in a further increase in the engine speed. Thus, there is involved a disadvantage that the variation of the engine speed is enhanced and the engine speed becomes unstable.

To overcome the foregoing disadvantage, it has been proposed to adjust the air-fuel ratio characteristic around the idling operation on the basis of a certain predetermined intake pipe pressure (an average idling intake pipe pressure of a large number of engines) in such a manner that when the engine speed becomes higher than a predetermined idling speed and the intake pipe pressure becomes lower than the predetermined intake pipe pressure, the basic fuel injection quantity is compensated to enrich the air-fuel mixture, whereas when the intake pipe pressure becomes higher than the predetermined intake pipe pressure, the compensation is effected to make the air-fuel mixture leaner. However, even if the basic fuel injection quantity is compensated on the basis of such a predetermined intake pipe pressure in such a manner that the mixture is enriched when the intake pipe pressure becomes lower than the predetermined pressure and the mixture is made leaner when the reverse is the case, the intake pipe pressure during an idling operation differs for every engine due to variations in performance of the respective engines. Therefore, it is impossible to expect an identical functional effect on all manufactured engines when they are put on the market. In addition, after the engines have been put to practical use the intake pipe pressure during an idling operation varies due to the wear and the secular variations of idling air flow, with the resultant deterioration of the stability of the idling operation and the exhaust emission. Further, with vehicles of the type employing an exhaust emission control system comprising an oxygen concentration sensor feedback system including a three-way catalyzer, even if the basic fuel injection quantity is compensated for variations in the intake pipe pressure with respect to the previously mentioned predetermined intake pipe pressure, the stability of an idling operation will be deteriorated considerably due to variations of the air-fuel ratio caused by the feedback action. Further, if the capacity of the surge tank is increased to increase the engine output, the phase difference between the engine speed and the fuel injection quantity will also be increased thus making the engine speed unstable, and after all making it practically impossible for the prior art methods to overcome these defects.

The present invention has been made in view of the foregoing defects involved in the prior art.

SUMMARY OF THE INVENTION

It is an object of the present invention to provide a method of controlling an engine equipped with an electronic fuel injection system by correcting at least one control variable in accordance with at least one operating parameter when the throttle is closed fully or nearly fully, the said method comprising the steps of computing the amount of the change of at least one operating parameter at a given time interval or a given engine crank angle interval, and correcting at least one control variable in accordance with the amount of the change, the proportion of the change determined in accordance with the amount of the change and the magnitude of the operating parameter, or the rate of incremental change of the amount of the change or the proportion of the change obtained at intervals of a given time period or a given engine crank angle, thereby to prevent variations of the engine speed during the respective periods of idling and low speed operations, to eliminate the adverse effects of variations in performance among respective engines, wear of engines, a secular change of idling air flow, etc., and also by preliminarily determining control variable correction values for the case where air-fuel ratio feedback compensation by the use of an oxygen sensor is effected and other control variable correction values for the case where no air-fuel ratio feedback compensation is effected, to provide different control variable correction values required by the engine according to each of these two cases, thereby stably controlling the engine speed during the respective periods of idling and low speed operations.

BRIEF DESCRIPTION OF THE DRAWINGS

In the drawings, like reference numerals refer to like parts or items.

DESCRIPTION OF THE PREFERRED EMBODIMENTS

Figure 1:
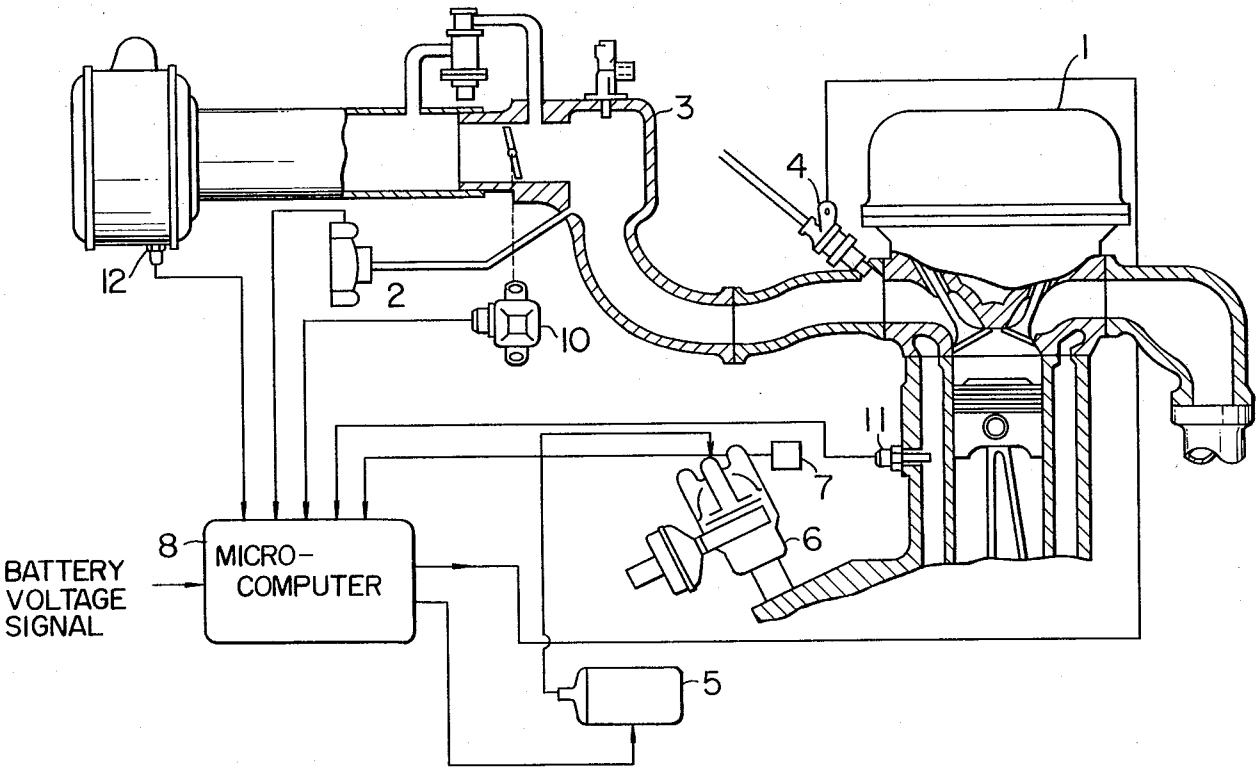
FIG. 1 is a schematic diagram showing a six-cylinder engine and its control apparatus for performing a control method according to the present invention.

The present invention will now be described in greater detail with reference to an embodiment illustrated in the accompanying drawings. FIG. 1 illustrates the construction of a six-cylinder engine 1 and its control system to which the control method according to the present invention has been applied. In the Figure, numeral 2 designates a semiconductor type intake pipe pressure sensor for sensing a pressure within an intake manifold 3, and 4 an electromagnetically operated fuel injection valve disposed in the intake manifold 3 near each of intake ports of the cylinders of the engine 1, to which fuel under a controlled pressure is forced. Numeral 5 designates an ignition coil which is a part of the ignition system, and 6 a distributor for distributing the ignition energy produced by the ignition coil 5 to spark plugs arranged in the respective cylinders. As is well known in the art, the distributor 6 is rotated once for every two revolutions of the engine crankshaft and it contains therein a rotational angle sensor 7 for sensing engine rotational angles.

Numeral 9 designates a throttle valve of the engine 1, and 10 a throttle sensor for sensing that the throttle valve 9 is closed fully or substantially fully. Numeral 11 designates a cooling water temperature sensor for sensing the state of warming-up of the engine 1, and 12 an intake air temperature sensor for sensing the temperature of air taken into the engine 1.

Numeral 8 designates a microcomputer for computing the magnitute and timing of engine control signals, and it is responsive to the signals from the intake pipe pressure sensor 2, the rotational angle sensor 7, the throttle sensor 10, the cooling water temperature sensor 11 and the intake air temperature sensor 12 as well as to a battery signal to compute the quantity of fuel supplied to the engine 1 through the fuel injection valves 4 and the ignition timing of the engine 1 on the basis of the above-mentioned signals.

Figure 2:
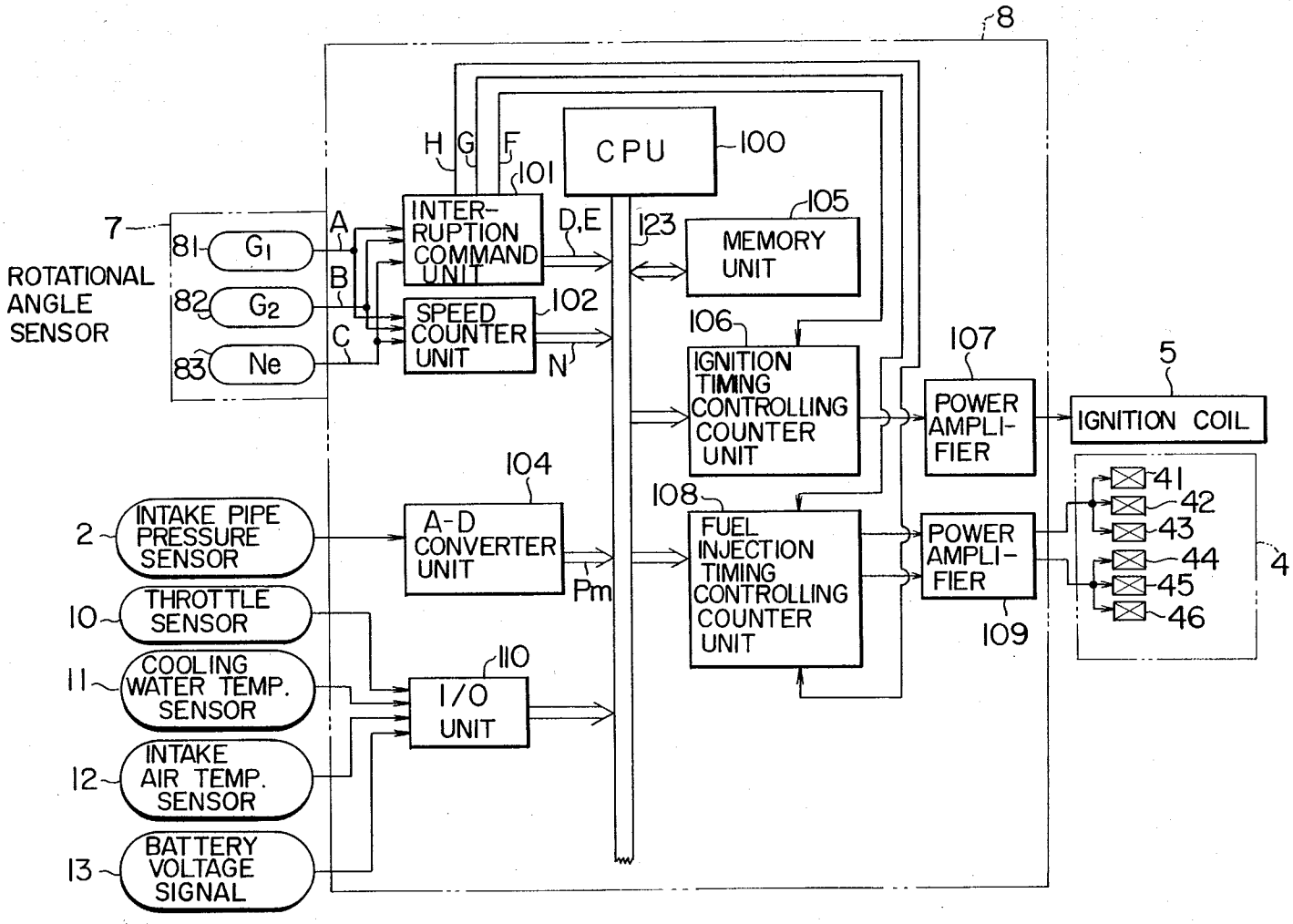
FIG. 2 is a block diagram showing the construction of the microcomputer shown in FIG. 1.

FIG. 2 is a block diagram for explaining in detail the construction of the microcomputer 8. In the Figure, numeral 100 designates a microprocessor unit (CPU) for performing interruption operations to compute the fuel injection quantity and the ignition timing. Numeral 101 designates an interruption command unit responsive to the rotational angle signals from the rotational angle sensor 7 contained in the distributor 6 to command the microprocessor unit 100 to perform the interruption operations for the computation of the fuel injection quantity and the ignition timing, respectively, with the data being transmitted to the microprocessor unit 100 via a common bus 123. The interruption command unit 101 also generates necessary timing signals for controlling the operation starting timing of units 106 and 108 which will be described later. Numeral 102 designates a speed counter unit responsive to the rotational angle signals from the rotational angle sensor 7 and the clock signals having a predetermined frequency which is supplied from the microprocessor 100 to count the period of a predetermined rotational angle and compute the engine speed. Numeral 104 designates an A-D converter unit which operates to subject the signal from the intake pipe pressure sensor 2 to A-D conversion and to make the microprocessor unit 100 read the resultant digital signals. Numeral 110 designates an input/output unit through which the output signals from the throttle sensor 10, the cooling water temperature sensor 11 and the intake air temperature sensor 12 as well as the battery voltage signal are received, converted to digital signals and then delivered. Numeral 105 designates a memory unit storing a control program for the microprocessor unit 100 and also storing the output data of the units 101, 102, 104 and 110. The transmission of data between the memory unit 105 and the microprocessor unit 100 is effected via the common bus 123. The output data from the units 102, 104 and 110 are transmitted to the microprocessor unit 100 or the memory unit 105 via the common bus 123. Numeral 106 designates an ignition timing controlling counter unit including a register whereby digital signals respectively indicative of the point where the ignition coil 5 is energized and the point where the ignition coil 5 is de-energized (or the ignition timing) computed by the microprocessor unit 100 are computed in terms of a time interval and a time point respectively corresponding to engine rotational angles (crank angles). Numeral 107 designates a power amplifier for amplifying the output signal from the ignition timing controlling counter unit 106 and controlling the time points where the ignition coil 5 is energized and de-energized, respectively, the latter time point being the ignition timing of the engine 1. Numeral 108 designates a fuel injection duration controlling counter unit including registers, and it comprises two downcounters having the same function which operate respectively to convert the digital signal indicative of the duration of opening of the fuel injection valves 4, namely, the fuel injection quantity computed by the microprocessor unit 100 to a pulse signal having a pulse time width which determines the opening time period of the fuel injection valves 4. Numeral 109 designates a power amplifier which receives and amplifies the output pulse signals from the counter unit 108 and supplies the resultant amplified signals to the fuel injection valves 4, and it comprises two channels in correspondence to the construction of the counter unit 108.

As shown in FIG. 2, the rotational angle sensor 7 comprises three sensors 81, 82 and 83. The first rotational angle sensor 81 is constructed so that an angle signal A is generated at position $\theta$ degrees before 0° crank angle once at every two revolutions of the engine crank-shaft (or one revolution of the distributor 6) as shown by the waveform in (A) of FIG. 3. The second rotational angle sensor 82 is constructed so that an angle signal B is generated at a position $\theta$ degrees before 360° crank angle once at every two revolutions of the engine crankshaft as shown by the waveform in (B) of FIG. 3. The third rotational angle sensor 83 is constructed so that angle signals of the same number as the engine cylinders are generated at equal intervals. That is, in the case of a six-cylinder engine as the present embodiment, six angle signals C are generated at intervals of 60 degrees at every revolution of the engine crankshaft, starting at 0° crank angle as shown by the waveform in (C) of FIG. 3.

The interruption command unit 101 is responsive to the respective angle signals (or the respective crankshaft rotational angle signals) from the rotational angle sensors 81, 82 and 83 to generate signals for commanding an interruption operation for computing the ignition timing and an interruption operation for computing the fuel injection quantity. That is, the frequency of the angle signals C from the third rotational angle sensor 83 is divided by a factor of 2 so that an interrupt command signal D is generated starting from just after the generation of the angle signal A from the first rotational angle sensor 81 as shown in (D) of FIG. 3. The interrupt command signal D is generated six times at every two crankshaft revolutions, that is, the interrupt command signals D of the same number as the engine cylinders are generated at every two crankshaft revolutions, and thus in the case of a six-cylinder engine the interrupt command signal D is generated at intervals of 120° crank angle to command an interruption for computing the ignition timing to the microprocessor unit 100. Also, the interruption command unit 101 divides the frequency of the angle signals C from the third rotational angle sensor 83 by a factor of 6 such that an interrupt command signal E is generated in response to the sixth signals C after the generation of the angle signals A and B from the first rotational angle sensor 81 and the second rotational angle sensor 82, respectively, that is, the signal E is generated at intervals of 360° (one crankshaft revolution) starting at 300° crank angle, as shown in (E) of FIG. 3, and the interrupt command signal E commands an interruption for computing the fuel injection quantity to the microprocessor unit 100.

Figure 3:
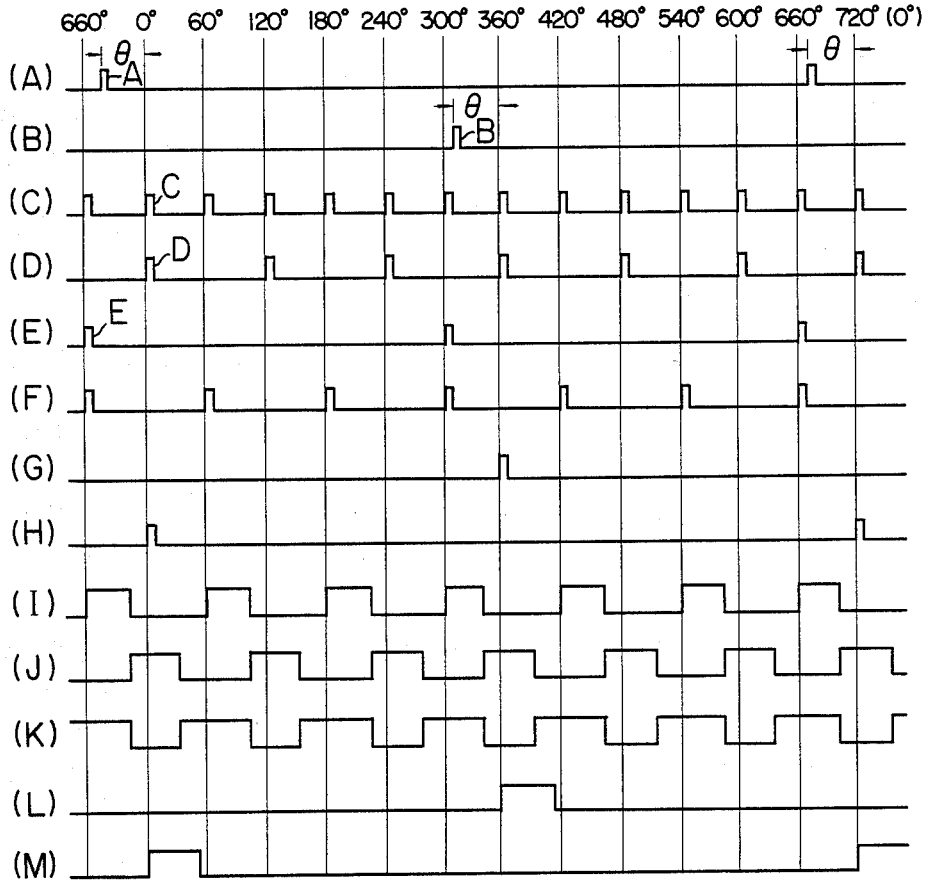
FIG. 3 shows a plurality of signal waveforms for use in explaining the operation of the control apparatus shown in FIG. 1.
Figure 4:
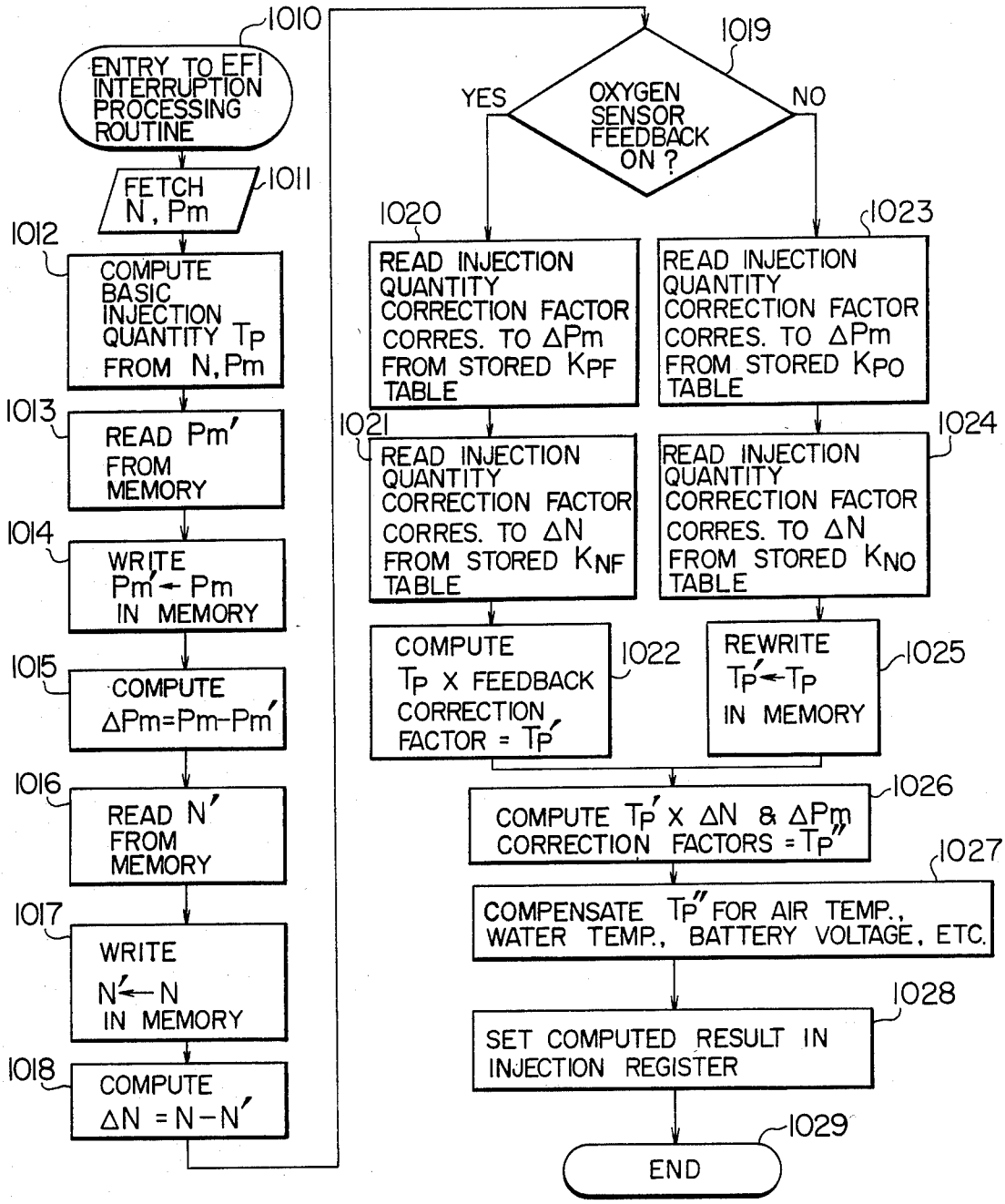
FIG. 4 is a schematic flow chart showing the interruption operations performed by the microcomputer for computing a basic fuel injection quantity correction value.

FIG. 4 is a schematic flow chart showing the computing operations performed by the microprocessor unit 100. The function of the microprocessor unit 100 will now be described with reference to the flow chart of FIG. 4. When the engine is started and the fuel injection quantity computing interruption command signal E shown in (E) of FIG. 3 is applied to the microprocessor unit 100 from the interruption command unit 101, even if the main routine is being processed, the microprocessor unit 100 immediately interrupts the processing of the main routine and the control is transferred to an entry step 1010 of the EFI interruption processing routine.

A step 1011 fetches from a RAM area in the memory unit 105 an engine speed indicative signal N generated by the speed counter unit 102 and stored in the memory unit 105 and an intake pipe pressure indicative signal Pm generated by the A-D converter unit 104 and stored in the memory unit 105. The next step 1012 computes a corresponding basic fuel injection quantity $T_p$ in accordance with a basic fuel injection quantity table stored in the memory unit 105 as a two-dimensional map for the values of N and Pm. A step 1013 fetches a signal P'm indicative of the intake pipe pressure, which was used in determining the basic fuel injection quantity $T_p$ in the preceding EFI interruption processing, from the RAM area of the memory unit 105 to the microprocessor unit 100, and the next step 1014 writes the signal Pm fetched by the step 1011 into the RAM area of the memory unit 105 in place of the signal P'm. The written signal Pm will be used as a next signal P'm in the succeeding EFI interruption processing. A step 1015 computes the amount of the change $\Delta Pm = Pm - P'm$ of the intake pipe pressure measured at intervals of 360° crankshaft rotation. The operations similar to those performed with respect to the intake pipe pressure through the steps 1013, 1014 and 1015 are performed with respect to the engine speed indicative signal N through steps 1016, 1017 and 1018 so as to determine the amount of the change $\Delta N = N - N'$ of the engine speed at intervals of 360° crankshaft rotation. The next step 1019 determines whether the air-fuel ratio feedback compensation by the use of an oxygen sensor is being applied or not. If it is, the control is transferred to a step 1020 where a fuel injection quantity correction factor corresponding to the amount of the intake pipe pressure change $\Delta Pm$ is read from a fuel injection quantity correction map $\tau$ (MAPPF) stored in the ROM area of the memory unit 105 to be used when the air-fuel ratio feedback compensation by the use of the oxygen sensor is being applied. The next step 1021 reads a fuel injection quantity correction factor corresponding to the engine speed change $\Delta N$ from a fuel injection quantity correction map $\tau$ (MAPNF) stored in the ROM area of the memory unit 105 to be used when the air-fuel ratio feedback compensation by the use of the oxygen sensor is being applied. A step 1022 applies the oxygen sensor air-fuel ratio feedback compensation to the basic fuel injection quantity $T_p$ obtained by the step 1012 to obtain a quantity $T'_p$. If the air-fuel ratio feedback compensation by the use of the oxygen sensor is not being applied, the control is transferred to a step 1023 where a fuel injection quantity correction factor corresponding to the intake pipe pressure change $\Delta Pm$ is read from a fuel injection quantity correction map $\tau$ ($MAPP\overline{O}$) stored in the ROM area of the memory unit 105 to be used when the air-fuel ratio feedback compensation by the use of the oxygen sensor is not being applied. A step 1024 reads a fuel injection quantity correction factor corresponding to the engine speed change $\Delta N$ from a fuel injection quantity correction map $\tau$ ($MAPN\overline{O}$) stored in the ROM area of the memory unit 105 to be used when the air-fuel ratio feedback compensation by the use of the oxygen sensor is not being applied. A step 1025 rewrites the basic injection quantity $T_p$ obtained by the step 1012 as $T'_p$. A step 1026 multiplies the basic injection quantity $T'_p$ by the correction factors corresponding to the changes $\Delta N$ and $\Delta Pm$ to obtain a quantity $T''_p$.

A step 1027 compensates the quantity $T''_p$ for variations in the cooling water temperature, intake air temperature, battery voltage, etc., and the next step 1028 sets the resultant computation data in the registers of the fuel injection duration controlling counter unit 108. Then, the process proceeds to a step 1029 thus completing the EFI interruption processing.

Figure 5:
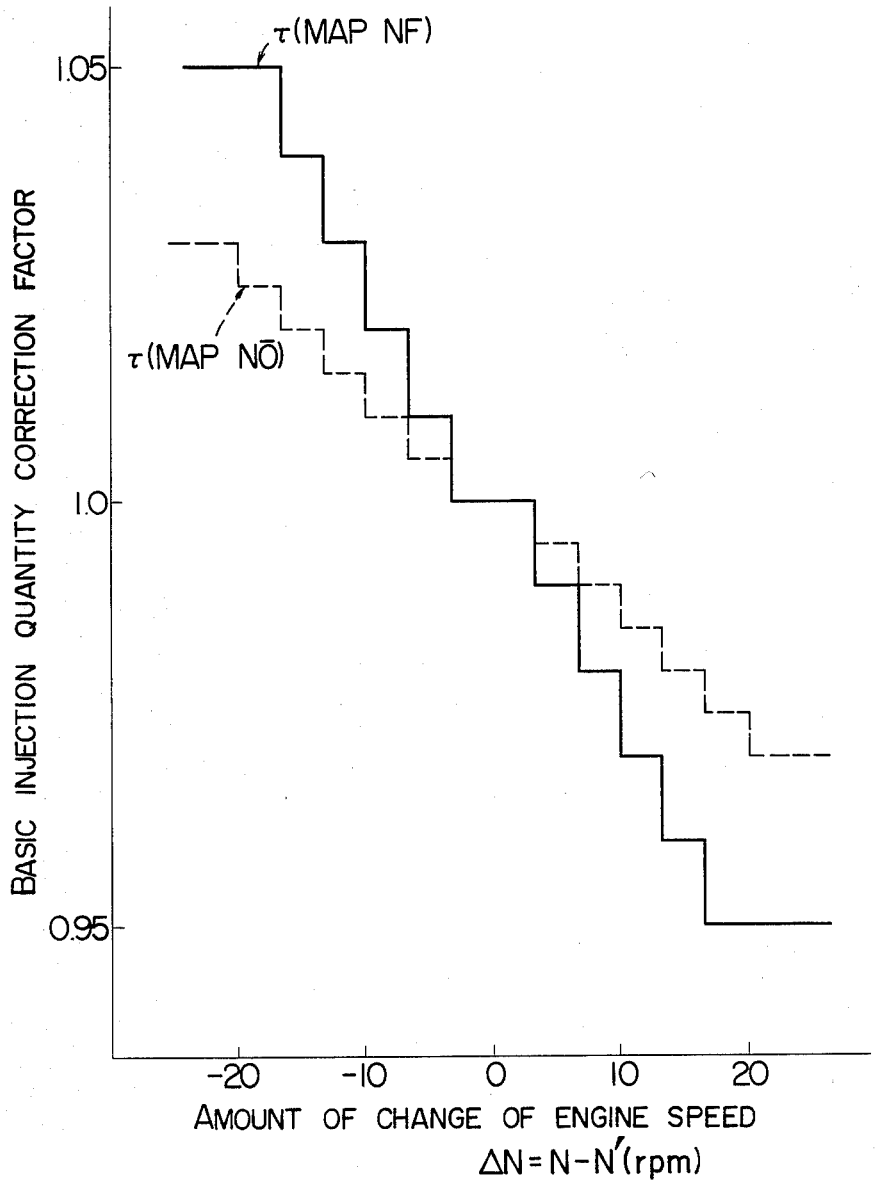
FIG. 5 shows two characteristic data maps preliminarily stored in the memory unit of the microcomputer of FIG. 1 and used to correct the fuel injection quantity in accordance with the amount of change of the engine speed.

A description will now be made of the fuel injection quantity correction maps with respect to the amount of the change of the intake pipe pressure and the amount of the change of the engine speed which are stored preliminarily at the designated locations in the ROM area of the memory unit 105. For instance, as shown in FIG. 5, the fuel injection quantity correction factors with respect to the amount of the change of the engine speed are stored preliminarily at the predetermined locations in the ROM area of the memory unit 105 as two characteristic data maps $\tau$ (MAPNF) and $\tau$ (MAPN$\overline{O}$) which are to be used respectively when the air-fuel ratio feedback compensation by the use of the oxygen sensor is being applied and when no feedback compensation is being applied. The fuel injection quantity correction maps with respect to the amount of the change of the intake pipe pressure are also stored preliminarily as two respective characteristic data maps in the way similar to the above.

The characteristics of these maps are such that, if the engine speed decreases and hence the amount of the change of the engine speed is negative, the fuel injection quantity is corrected in a direction to be increased thereby increasing the generation of the engine torque and preventing a further drop in the engine speed. On the contrary, if the engine speed increases and hence the amount of the change of the engine speed is positive, the fuel injection quantity is corrected in a direction to be decreased so that the generation of the engine torque is decreased and the engine speed is prevented from increasing further.

Further, by virtue of the fact that the different control variable correction values are used between the cases where the air-fuel ratio feedback compensation by the use of the oxygen sensor is being applied and where the compensation is not being applied, it is possible to satisfy the different control variable correction values required by the engine in the two cases thereby to attain improved idling stability.

While the above-described embodiment is directed to a method for controlling the engine speed through the correction of the composition of the air-fuel mixture, the same effects can be obtained by the correction of the ignition timing.

Figure 6:
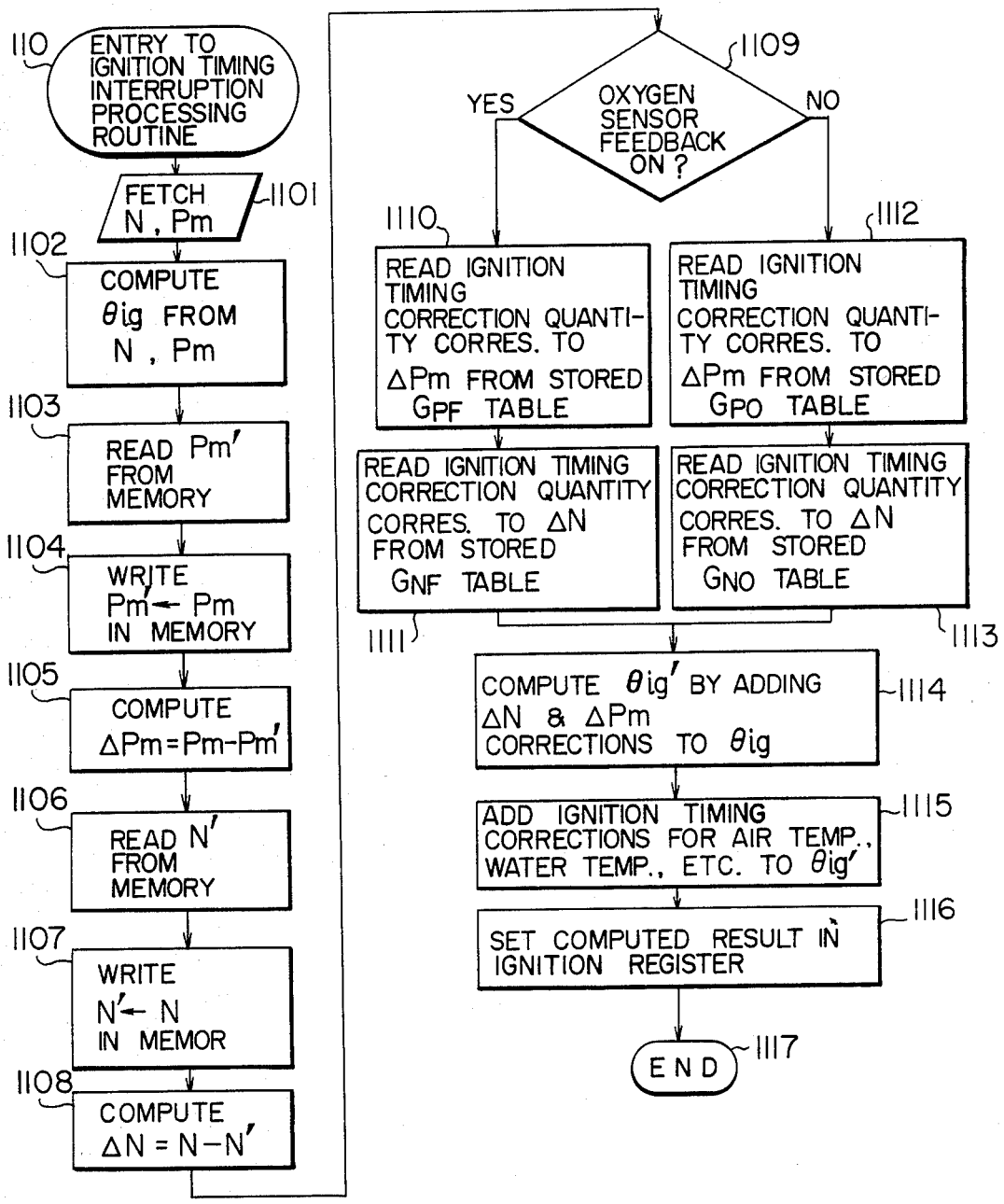
FIG. 6 is a schematic flow chart showing the interruption operations performed by the microcomputer for computing a basic ignition timing correction value.

FIG. 6 shows a flow chart of the computing operations for the purpose of correcting the ignition timing.

When the engine is started and the ignition timing computing interruption command signal D shown in (D) in FIG. 3 is applied to the microprocessor unit 100 from the interruption command unit 101, even if the main routine is being processed, the microprocessor unit 100 interrupts the processing of the main routine and the control is transferred to an entry step 1100 of the ignition timing interruption processing routine. A step 1101 reads an intake pipe pressure indicative signal and an engine speed indicative signal into the microprocessor unit 100. A step 1102 computes a corresponding basic ignition timing $\theta$ig in accordance with the intake pipe pressure and the engine speed. The succeeding steps 1103, 1104, 1105, 1106, 1107 and 1108 perform the operations similar to those performed by the steps 1013, 1014, 1015, 1016, 1017 and 1018 of the EFI interruption processing routine shown in FIG. 4. A step 1109 determines whether the air-fuel ratio feedback compensation by the use of the oxygen sensor is being applied or not. If the feedback compensation is being applied, the process is transferred to a step 1110 where an ignition timing correction value corresponding to the intake pipe pressure change $\Delta$Pm is read from an ignition timing correction map $\theta$ig (MAPPF) stored in the ROM area of the memory unit 105 to be used when the air-fuel ratio feedback compensation by the use of the oxygen sensor is being applied, and the next step 1111 reads an ignition timing correction value corresponding to the engine speed change $\Delta$N from an ignition timing correction map $\theta$ig (MAPNF) stored in the ROM area of the memory unit 105 to be used when the air-fuel ratio feedback compensation by the use of the oxygen sensor is being applied.

On the other hand, if the air-fuel ratio feedback compensation by the use of the oxygen sensor is not being applied, a step 1112 reads an ignition timing correction value corresponding to the intake pipe pressure change $\Delta$Pm from an ignition timing correction map $\theta$ig (MAPP$\overline{O}$) stored in the ROM area of the memory unit 105 to be used when the air-fuel ratio feedback compensation by the use of the oxygen sensor is not being applied, and the next step 1113 reads an ignition timing correction value corresponding to the engine speed change $\Delta$N from an ignition timing correction map $\theta$ig (MAPN$\overline{O}$) stored in the ROM area of the memory unit 105 to be used when the air-fuel ratio feedback compensation by the use of the oxygen sensor is not being applied. A step 1114 adds the ignition timing correction values corresponding to $\Delta$N and $\Delta$Pm to the basic ignition timing $\theta$ig to obtain a value $\theta$ig'. A step 1115 adds the ignition timing correction values for the intake air temperature, cooling water temperature, etc., to the value $\theta$ig'. A step 1116 sets the resultant ignition timing computation data in the register of the ignition timing controlling counter unit 106. Then, the process is transferred to a step 1117 thus completing the ignition timing interruption processing.

Figure 7:
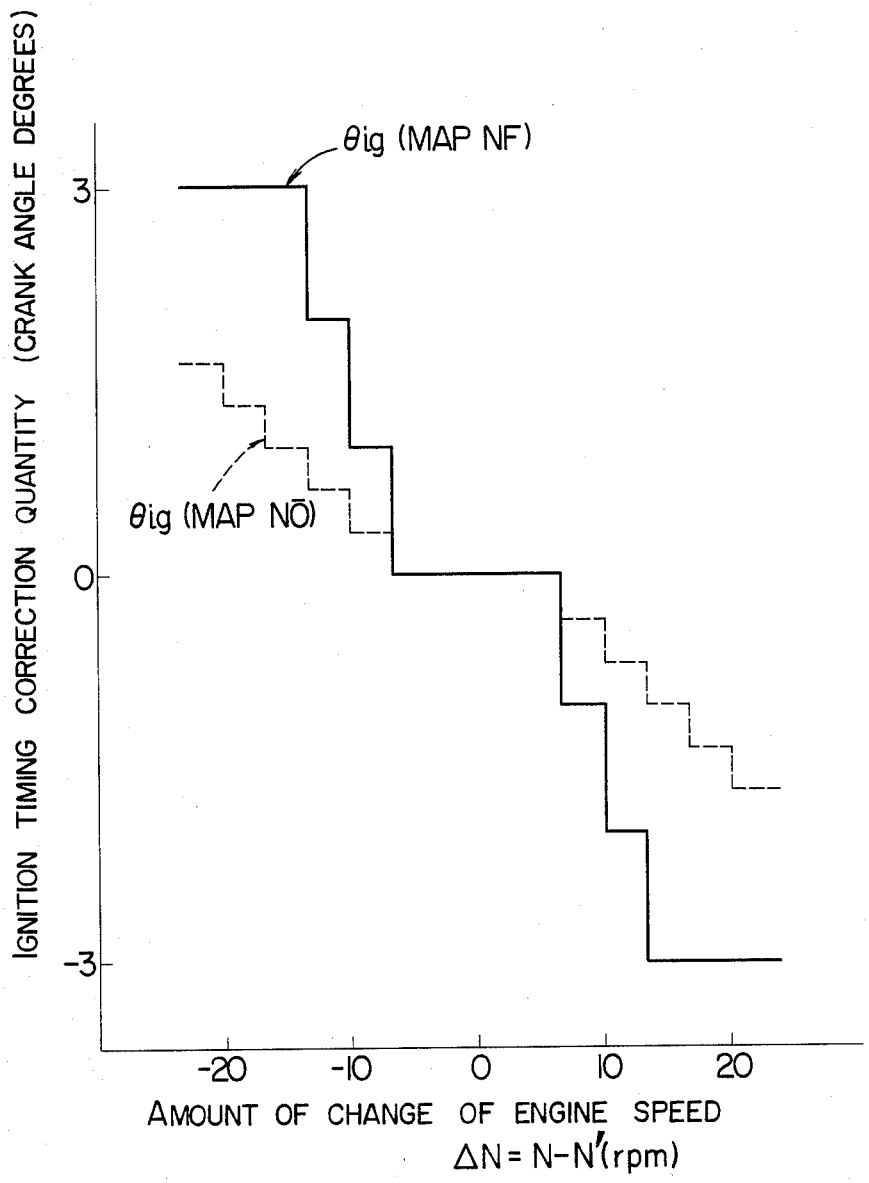
FIG. 7 shows two characteristic data maps preliminarily stored in the memory unit of the microcomputer shown in FIG. 1 and used to correct the ignition timing in accordance with the amount of change of the engine speed.

A description will now be made of the ignition timing correction maps with respect to the amount of the change of the intake pipe pressure and the amount of the change of the engine speed which are stored preliminarily at the designated locations in the ROM area of the memory unit 105. For instance, as shown in FIG. 7, the ignition timing correction values with respect to the amount of the change of the engine speed are stored preliminarily at the predetermined locations in the ROM area of the memory unit 105 as two characteristic data maps $\theta$ig (MAPNF) and $\theta$ig (MAPN$\overline{O}$) which are to be used respectively when the air-fuel ratio feedback compensation by the use of the oxygen sensor is being applied and when no compensation is being applied. The ignition timing correction values with respect to the amount of the change of the intake pipe pressure are stored similarly as two respective characteristic data maps.

More specifically, the characteristics of the maps are such that, when the engine speed decreases and hence the amount of the change of the engine speed is negative, the ignition timing is adjusted in a direction to be advanced thereby increasing the generation of the engine torque and preventing the engine speed from decreasing further. On the contrary, when the engine speed increases and hence the amount of the change of the engine speed is positive, the ignition timing is adjusted in a direction to be retarded so that the generation of the engine torque is decreased and the engine speed is prevented from increasing further.

While, in the above-described embodiment, the amount of the change of each of the engine operating parameters is used to correct the engine control variables, similar effects can be obtained by using the proportion of the change obtained in accordance with the amount of the change and the magnitude of each of the engine operating parameters, or the rate of incremental change of the amount of the change or the proportion of the change obtained at intervals of a predetermined time period or a predetermined engine crack angle.

Further, simultaneous corrections in accordance with the composition of the air-fuel mixture as well as the ignition timing make it possible to effect more precise control of an engine.

It will be seen from the foregoing descriptions that, in accordance with the present invention, by virtue of the fact that control variables of an engine equipped with an electronic fuel injection system such as the ignition timing and the fuel injection quantity are corrected in accordance with the amount of the change or the proportion of the change of engine operating parameters such as the engine speed and the intake pipe pressure or the rate of incremental change of the amount of the change or the proportion of the change obtained at intervals of a predetermined time period or a predetermined engine crank angle, there is brought a great advantage that the rotational speed of the engine can be stabilized during idling and low speed operations of the engine and that any variation of the rotational speed of the engine can be rapidly removed in response to the existing operating conditions of the engine, thereby preventing the driver from suffering from undesirable vibrations. Another great advantage brought by the present invention is that the controllability of an engine is not affected by variations in performance among respective engines, wear of engines, a secular change of idling air flow, etc.

We claim:

1. An apparatus for controlling an internal combustion engine of the type having an electronically controlled fuel injection system effecting air-fuel ratio feedback compensation by using an oxygen sensor for sensing an oxygen content of an exhaust gas from said engine, in which at least one of a plurality of control variables of said engine is corrected in accordance with at least one of a plurality of operating parameters of said engine to stabilize at rotational speed of said engine, said apparatus comprising:

a sensor for detecting said one operating parameter; and computing means comprising input/output means for receiving an output signal of said sensor, an interruption command unit, memory means, a computing unit and output means of said computing means, whereby in accordance with the determination as to whether said air-fuel ratio feedback compensation by using the oxygen sensor is effected or not by said electronically controlled fuel injection system and in accordance with data related to an amount of change of said one operating parameter obtained at intervals of a predetermined period, correction values for said control variable are computed, said control variable is corrected in accordance with said correction values, and a signal indicative of said corrected control variable is output from said output means, wherein said computing means has an interruption processing control program stored in said memory means thereby to perform said determination, computation, correction and outputting in response to an interruption command signal generated from said interruption command unit, and wherein said memory means stores therein two different data maps to be used separately in dependence on whether said air-fuel ratio feedback compensation by using the oxygen sensor is effected or not, each of said data maps determining the relationship between the amount of change of said operating parameter and correction factors for computing correction values of said control variable, and wherein said interruption processing control program includes processing steps whereby correction factors for said control variable corresponding to the amount of change of said one operating parameter are read from a corresponding one of said data maps depending on whether said air-fuel ratio feedback compensation by using the oxygen sensor is effected or not.

2. A method for controlling rotational speed of an internal combustion engine having an electronically controlled fuel injection system and an ignition system comprising the steps of:

sensing a pressure in an intake pipe of said engine, a rotational speed of said engine and an oxygen content in the exhaust of said engine;

determining an amount of fuel to be injected into said engine in accordance with said sensed pressure, rotational speed and oxygen content, said sensed oxygen content being used only when a feedback control responsive to said sensed oxygen content is desired;

monitoring whether said feedback control is effected or not;

detecting an amount of change in at least one of said sensed pressure and rotational speed between the precedingly sensed one and the currently sensed one;

determining a fuel correction value in dependence on said detected amount of change, said fuel correction value being varied in dependence on the result of said monitoring step;

correcting said determined amount of fuel to be injected by said determined fuel correction value;

injecting said corrected amount of fuel into said engine to be ignited by said ignition system;

repeating said sequence of steps;

determining an ignition timing in accordance with said sensed pressure and rotational speed;

determining an ignition correction value in dependence on said detected amount of change, said ignition correction value being varied in dependence on the result of said monitoring step;

correcting said determined ignition timing by said determined ignition correction value; and igniting said injected fuel at said corrected ignition timing, wherein said change detecting step detects said amount of change in both said sensed pressure and rotational speed.

3. A control apparatus according to claim 1, wherein said control variable correction factors in each of said data maps are determined to compensate for the amount of change of said one operating parameter, and wherein said correction factors for said control variable corresponding to the amount of change of said one operating parameter are made to take different values depending on whether said air-fuel ratio feedback compensation by using the oxygen sensor is being effected or not.

4. A method for controlling an internal combustion engine of the type having an electronically controlled fuel injection system effecting air-fuel ratio feedback compensation by using an oxygen sensor for sensing an oxygen content of an exhaust gas from said engine, in which at least one of a plurality of control variables of said engine is corrected in accordance with at least one of a plurality of operating parameters of said engine to stabilize a rotational speed of said engine, said method comprising the steps of:

detecting an amount of change of said one operating parameter at intervals of a predetermined period;

determining for at least said one control variable and in accordance with data related to the amount of change of said one operating parameter, at intervals of said predetermined period, a first group of correction values if said air-fuel ratio feedback compensation is effected by use of said oxygen sensor and a second group of correction values if said compensation is not effected by use of said oxygen sensor;

correcting said control variable by using the determined correction values of one of said groups; and controlling said engine by applying said corrected control variable thereto.

5. A method for controlling rotational speed of an internal combustion engine having an electronically controlled fuel injection system and an ignition system comprising the steps of:

sensing a pressure in an intake pipe of said engine, a rotational speed of said engine and an oxygen content in the exhaust of said engine;

determining an amount of fuel to be injected into said engine in accordance with said sensed pressure, rotational speed and oxygen content, said sensed oxygen content being used only when a feedback control responsive to said sensed oxygen content is desired;

monitoring whether said feedback control is effected or not;

detecting an amount of change in at least one of said sensed pressure and rotational speed between the precedingly sensed one and the currently sensed one;

determining, in dependence on said detected amount of change, a first group of fuel correction values if said monitoring indicates said feedback control is effected and a second group of fuel correction values if said feedback control is not effected;

correcting said determined amount of fuel to be injected by one of said groups of determined fuel correction values;

injecting said corrected amount of fuel into said engine to be ignited by said ignition system; and repeating said sequence of steps.

6. An apparatus for controlling an internal combustion engine of the type having an electronically controlled fuel injection system effecting air-fuel ratio feedback compensation by using an oxygen sensor for sensing an oxygen content of an exhaust gas from said engine, in which at least one of a plurality of control variables of said engine is corrected in accordance with at least one of a plurality of operating parameters of said engine to stabilize at rotational speed of said engine, said apparatus comprising:

a sensor for detecting said one operating parameter; and computing means comprising input means for receiving an output signal of said sensor and output means for computing for at least said one variable and in accordance with data related to an amount of change of said one operating parameter obtained at intervals of a predetermined period, a first group of correction values if said air-fuel ratio compensation is effected by said electronically controlled fuel injection system using said oxygen sensor and a second group of correction values if said compensation is not effected by using said oxygen sensor, for correcting said one control variable in accordance with the computed correction values of one of said groups, and for outputting via said output means a signal indicative of said corrected control variable.

7. A control method according to claim 4, wherein said operating parameters include at least a rotational speed of said engine and a pressure in an intake pipe of said engine.

8. A control method according to claim 4 or 7, wherein said control variables include at least one of a fuel injection quantity and an ignition timing of said engine.

9. A control method according to claim 4, wherein the predetermined period is a predetermined time period.

10. A control method according to claim 4, wherein the predetermined period is a predetermined rotational angle of a crankshaft of said engine.

11. A method according to claim 5 further comprising the steps of:

determining an ignition timing in accordance with said sensed pressure and rotational speed;

determining an ignition correction value in dependence on said detected amount of change, said ignition correction value being varied in dependence on the result of said monitoring step;

correcting said determined ignition timing by said determined ignition correction value; and igniting said injected fuel at said corrected ignition timing.

12. A control apparatus according to claim 6, wherein said computing means has memory means and an interruption processing control program stored therein for performing said computating, correction and outputting in response to an interruption command signal.

13. A control apparatus according to claim 6, wherein the predetermined period is a predetermined time period.

14. A control apparatus according to claim 6, wherein the predetermined period is a predetermined rotational angle of a crankshaft of said engine.

* * * * *